US012768128B2

(12) United States Patent
Thompson

(10) Patent No.: US 12,768,128 B2
(45) Date of Patent: Oct. 20, 2026

(54) THUMB APPARATUS FOR GROUND ENGAGING WORK TOOL

(71) Applicant: Caterpillar Inc., Peoria, IL (US)

(72) Inventor: Mark W. Thompson, Manhattan, KS (US)

(73) Assignee: Caterpillar Inc., Peoria, IL (US)

( * ) Notice: Subject to any disclaimer, the term of this patent is extended or adjusted under 35 U.S.C. 154(b) by 582 days.

(21) Appl. No.: 18/128,133

(22) Filed: Mar. 29, 2023

(65) Prior Publication Data

US 2024/0328110 A1 Oct. 3, 2024

(51) Int. Cl.
*E02F 3/40* (2006.01)
*E02F 3/36* (2006.01)

(52) U.S. Cl.
CPC ..... *E02F 3/404* (2013.01); *E02F 3/3654* (2013.01)

(58) Field of Classification Search
CPC ..... E02F 3/404; E02F 3/3631; E02F 3/3654; E02F 3/3659; E02F 3/3663; E02F 3/4135; E02F 3/413
See application file for complete search history.

(56) References Cited

U.S. PATENT DOCUMENTS 4,155,473 A 5/1979 Holopainen
4,799,852 A * 1/1989 Ramun ..... E02F 3/404 37/406
5,971,455 A * 10/1999 Wolin ..... B66C 3/16 414/739
6,453,586 B1 * 9/2002 Wolin ..... B66C 3/16 37/406
6,589,007 B2 7/2003 Burton
7,111,419 B1 * 9/2006 Miller ..... E02F 3/404 37/406
7,533,481 B2 * 5/2009 McCoy ..... E02F 3/404 37/406
7,617,619 B2 * 11/2009 Cox ..... E02F 3/404 37/406
9,777,458 B2 * 10/2017 Bargellini ..... E02F 3/40
10,774,498 B2 9/2020 Frey et al.
10,774,501 B2 9/2020 Frey et al.
2002/0059741 A1 * 5/2002 Wolin ..... B66C 3/16 37/406

(Continued)

FOREIGN PATENT DOCUMENTS

CN 201195854 Y 2/2009
DE 202011108128 U1 2/2012

(Continued)

OTHER PUBLICATIONS

Written Opinion and International Search Report for Int'l. Patent Appln. No. PCT/US2024/016591, mailed Jul. 8, 2024 (13 pgs).

*Primary Examiner* — Christopher J Sebesta
*Assistant Examiner* — Blake E Scoville

(57) ABSTRACT

An apparatus includes a top assembly having a top member with a front edge and a back edge, and the top assembly is attached to a ground engaging tool. A thumb assembly is attached to the top member, which includes a mount extending from the front edge of the top member, at least one arm attached to the mount, and at least one actuator attached to the mount and the at least one arm. The actuator is configured to move the at least one arm with respect to the ground engaging tool.

19 Claims, 18 Drawing Sheets

(56) References Cited

U.S. PATENT DOCUMENTS

| | | | | |
|---|---|---|---|---|
| 2008/0282585 | A1 | 11/2008 | Cox | |
| 2022/0136202 | A1 * | 5/2022 | Mcguckin | E02F 3/404 37/406 |

FOREIGN PATENT DOCUMENTS

| | | | | |
|---|---|---|---|---|
| JP | S6168935 | A | 4/1986 | |
| KR | 200344098 | Y1 | 3/2004 | |
| WO | 9502095 | | 1/1995 | |
| WO | WO-9502095 | A1 * | 1/1995 | E02F 3/404 |

* cited by examiner

THUMB APPARATUS FOR GROUND ENGAGING WORK TOOL

TECHNICAL FIELD

This disclosure relates to a thumb apparatus and system for mounting on a ground engaging work tool.

BACKGROUND

Hydraulic thumbs such as those disclosed in, for example, U.S. Pat. Nos. 9,777,458 and 6,589,007; WO 9502095 and U.S. Patent Publication 2022/0136202 are versatile attachments for machines such as, for example, backhoes, excavators, mini-excavators, tractors, and skid-steer loaders. When the hydraulic thumb is mounted to an arm on the machine, the machine operator can precisely retain bulky objects picked up with the bucket. The hydraulic thumb is capable of moving through a wide range of motion, which can allow an operator to pick and place objects with increased versatility and load control.

However, in some cases, the thumb assembly can make switching between pin on work tools inconvenient. For example, the work tool and thumb are sometimes pinned onto the arm of the machine with the same pin. In another example, mounting brackets may need to be added to the arm of the machine to attach a hydraulic cylinder/link to operate a particular thumb assembly.

Further, when a thumb assembly is not needed for a particular job or task, the thumb assembly adds size and weight to the bucket, which can reduce the stability of the machine and increase fuel burn.

Thumb assemblies are needed that make possible quick and easy mounting on or removal from a machine. In addition, a thumb assembly should be easily attachable without preconfigured mounts on the machine.

SUMMARY OF THE INVENTION

In one aspect, the present disclosure is directed to a thumb apparatus mountable on a front edge of a torque transferring top member of a ground engaging tool such as, for example, a bucket, a rake, a fork, and the like. The thumb apparatus may be integrated onto ground engaging tools used with a wide variety of machines such as excavators, backhoes, tractors, skid-steer loaders, and the like.

The thumb apparatus includes actuators and pin connections that are all integrated onto a front side of the ground engaging tool, so the thumb apparatus can be rapidly installed on an existing tool, or easily switched between tools of similar size. Since the thumb apparatus is on the front side of the tool, the combined thumb/tool can be easily installed on a stick of a machine using standard pins or quick couplers. The front-mounted location of the thumb apparatus maintains the tip radius of the tool and allows the thumb apparatus and the tool to move in unison, so the presence of the thumb apparatus does not reduce the breakout force of the tool.

In some examples, the thumb apparatus of the present disclosure can be provided as a kit that is easily switchable between multiple similarly sized machines within a fleet.

BRIEF DESCRIPTION OF THE DRAWINGS

Like symbols in the drawings represent like elements.

DETAILED DESCRIPTION

Figure 1A:
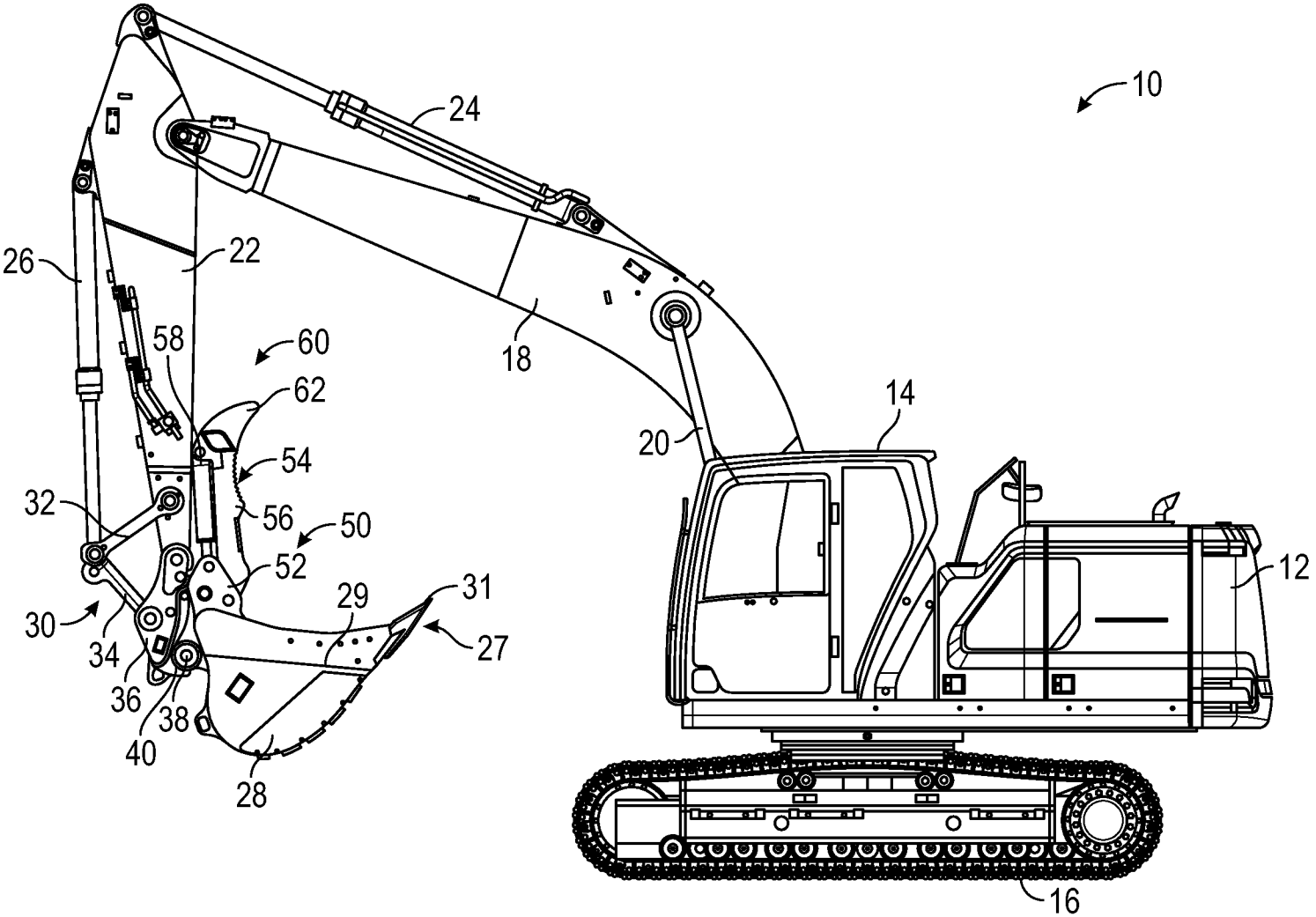
FIG. 1A is a side view of an embodiment of the thumb apparatus of the present disclosure mounted on an excavator bucket via a quick coupler.

Referring now to FIG. 1A, an embodiment of the thumb apparatus of the present disclosure is shown attached to a bucket of an excavator. However, as noted above, it should be understood that the thumb apparatus of the present disclosure can be used with any type of equipment including ground engaging tools such as, for example, draglines, mini-excavators, backhoes, skid-steer loaders, tractors, and the like. In the example embodiment of FIG. 1A, which is not intended to be limiting, an excavator 10 includes a cab body 12 enclosing an engine, a hydraulic pump, and control valves (not shown in FIG. 1A) for activating hydraulic cylinders on various attachments as selected by an operator utilizing controls in a cab 14. In some examples, the excavator 10 may be moved to a desired location using a system of tracks 16.

The excavator 10 further includes a boom 18 operated by one or more hydraulic cylinders 20. The boom 18 is connected to a stick 22 operated by a hydraulic cylinder 24 on the boom 18. The stick 22 includes a hydraulic cylinder 26 operable to move a ground engaging tool such as a bucket 28 between an extended position and the retracted position shown in FIG. 1A. The bucket 28 includes a ground engaging base member 27 with ground engaging elements 31 such as, for example, an arrangement of tines.

The hydraulic cylinder 26 on the stick 22 is connected to the bucket 28 via a system of linkages 30. In the embodiment of FIG. 1A, the linkages 30 include a first link 32 attached to the stick 22, and a second link 34 attached to a quick coupler 36. The quick coupler 36 in turn engages via pins 38 to an interface member such as, for example, hinge plates 40, which are attached to the bucket 28.

The thumb apparatus 50, which is mounted on a front surface 29 of the bucket 28, includes an arrangement of mounting flanges 52 for attachment to the bucket 28. The flanges 52 also attach to a frame 54 that includes at least one arm 56 moveable with at least one actuator such as, for example, a hydraulic cylinder 58. It should be understood that the actuator configured to move the arm 56 can be hydraulic, electric, or a combination thereof. The frame 54 further includes a distal edge 60 with protruding elements 62 configured to engage the ground engaging base member 27 of the bucket 28.

As shown in FIG. 1A, the frame 54 of the thumb apparatus 50, when in a fully open position, can rest against the stick 22, which reduces the likelihood of inadvertent damage to the thumb apparatus 50 as the excavator 10 traverses different job sites.

Figure 1B:
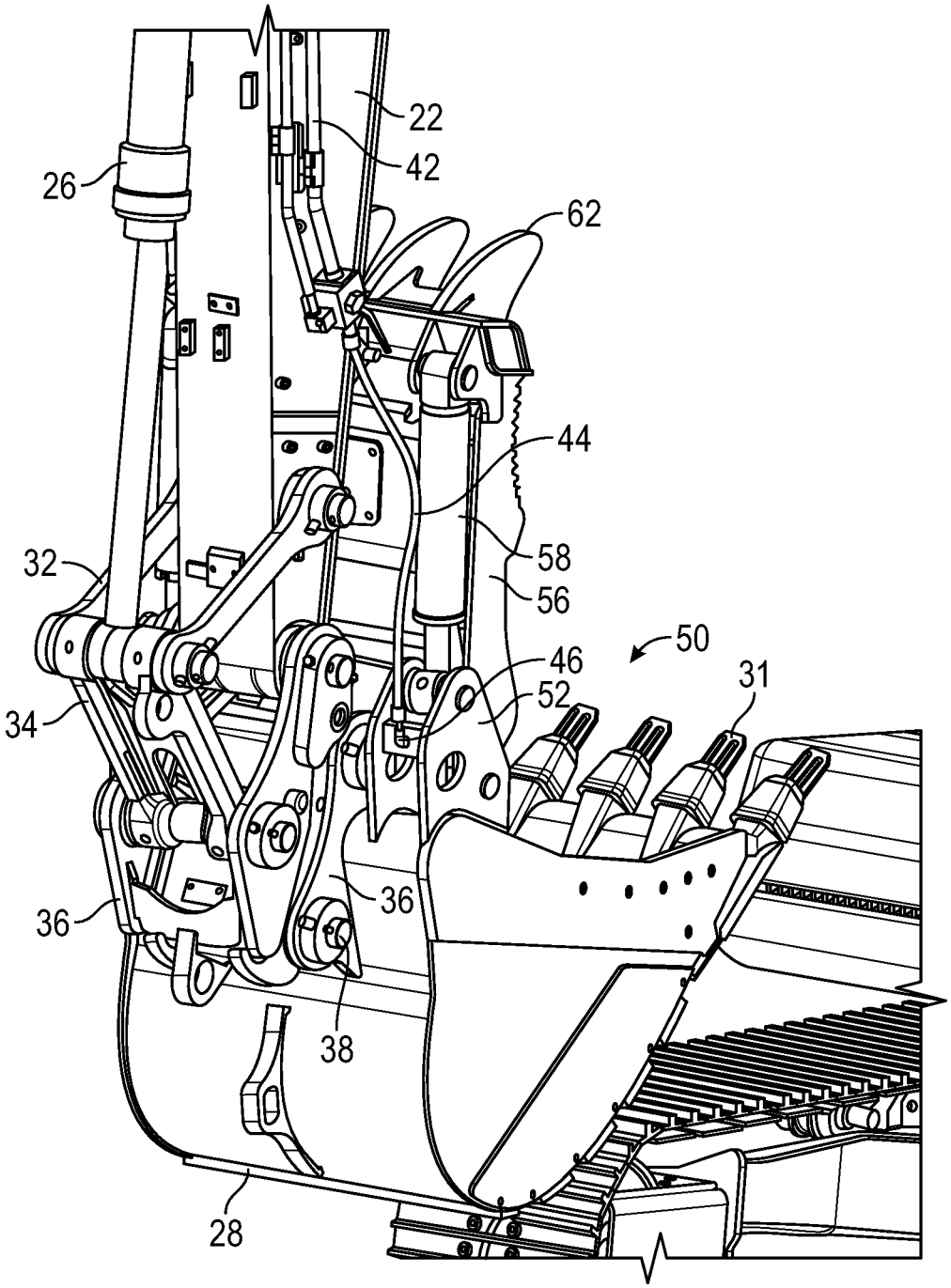
FIG. 1B is a perspective view of a back side of the thumb apparatus of FIG. 1A.

Referring now to FIG. 1B, the stick 22 includes hydraulic lines 42, which are connected to hydraulic lines 44 configured to power the thumb apparatus 50. As shown in FIG. 1B, the hydraulic lines 44 are attached to fittings 46 on one or more of the flanges 52, which can be useful in preventing damage to the fittings 46 and the lines 44 during operation of the thumb apparatus 50.

Figure 2:
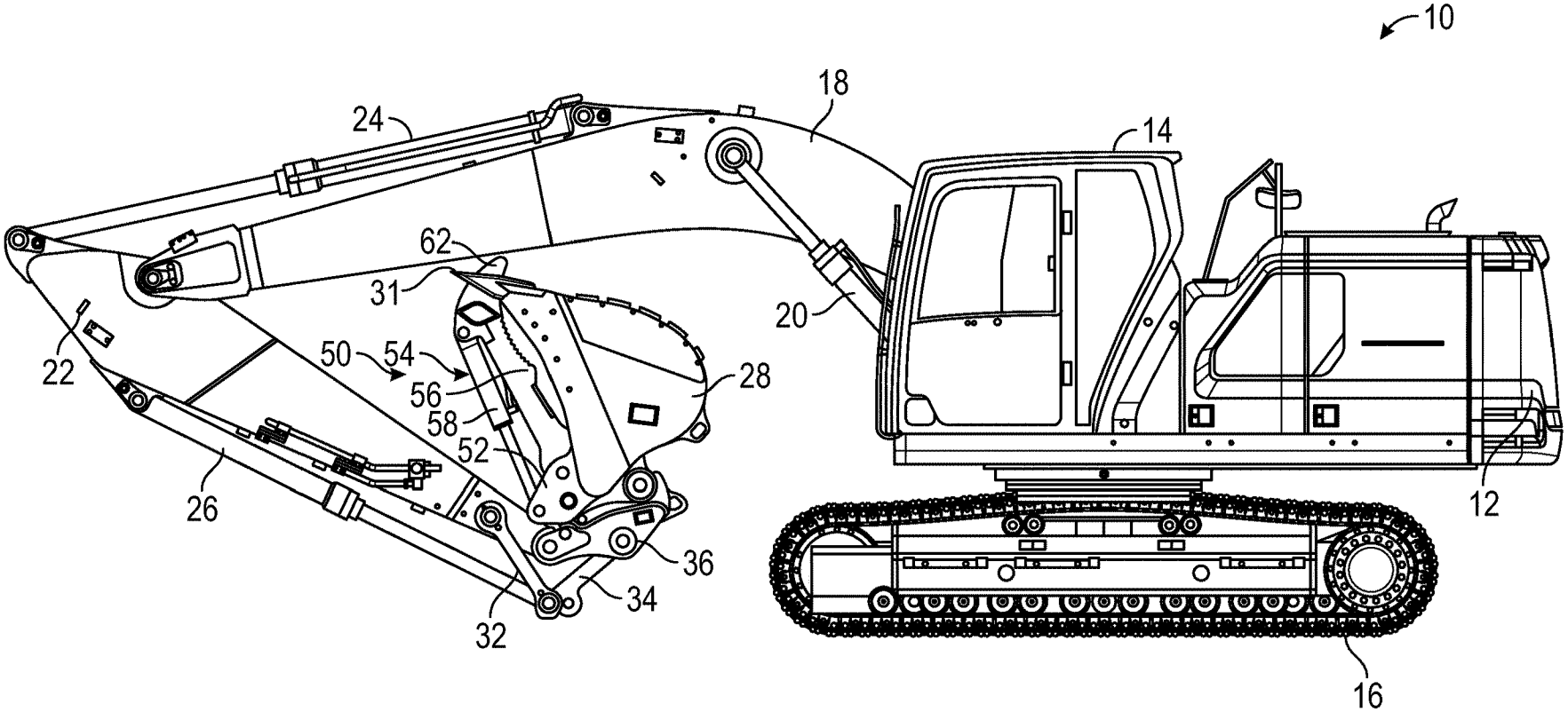
FIG. 2 is a side view of an embodiment of the thumb apparatus of the present disclosure mounted on an excavator bucket via a quick coupler.

FIG. 2 provides an example in which the stick 22 and the bucket 28 are in a retracted position and the thumb apparatus 50 is in a closed position. As shown in FIG. 2, when the thumb apparatus 50 is in a closed position, the protruding elements 62 on the distal end of the arms 56 engage with the ground engaging elements 31 on the bucket 28 to form a closed system.

Figure 3A:
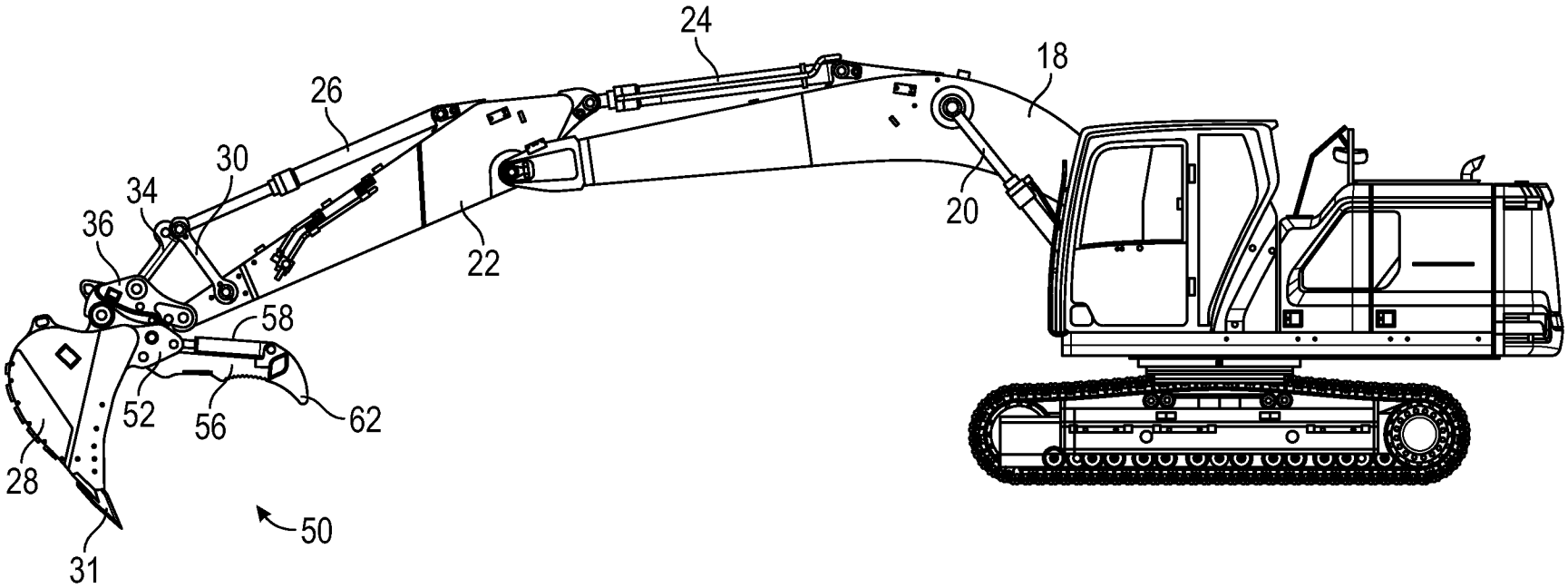
FIG. 3A is a side view of an embodiment of the thumb apparatus of the present disclosure mounted on an excavator bucket via a quick coupler.

FIG. 3A provides an example in which the stick 22 and the bucket 28 are in an extended or deployed position, and the thumb apparatus 50 is in an open position. As illustrated in FIG. 3A, the thumb apparatus 50 does not interfere with the operation of the bucket 28 when the bucket 28 is deployed, and allows free movement of the bucket 28 so that the ground engaging elements 31 can penetrate the ground or pick up dirt or debris.

Figure 3B:
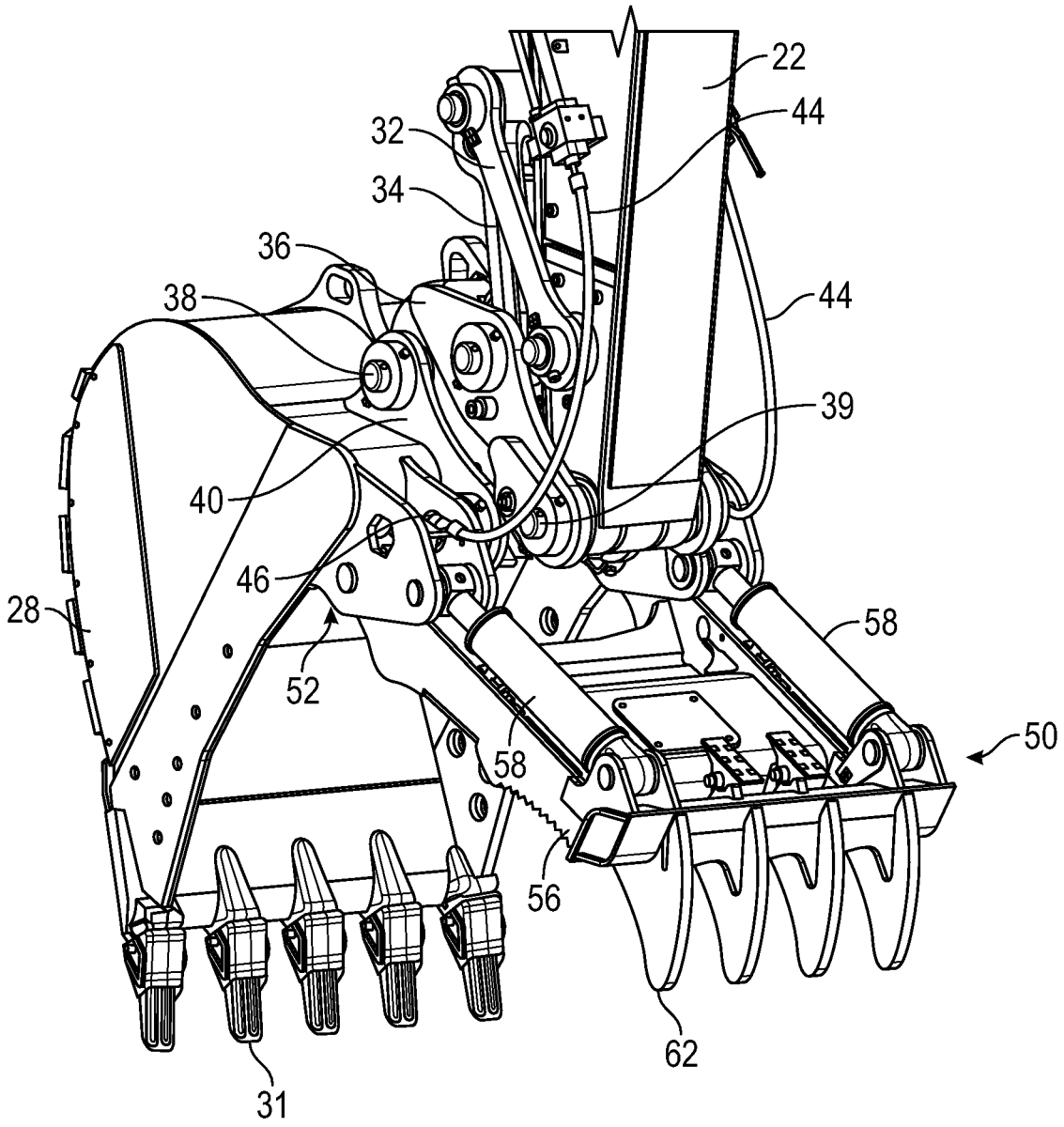
FIG. 3B is a perspective view of a front side of the thumb apparatus of FIG. 1A.

FIG. 3B further illustrates the deployed bucket and open thumb apparatus of FIG. 3A. As shown in FIG. 3B, in some examples, multiple sets of hydraulic lines 44 may be used to activate the thumb apparatus 50. FIG. 3B also shows that the hinge plates 40 on the bucket 28 engage a power linkage pin 38 attached to the quick coupler 36, as well as a stick pin 39 attached on the stick 22. Power applied to the power linkage pin 38 causes the bucket 28 to rotate about the stick pin 39 from an extended position to a retracted position.

Figure 4:
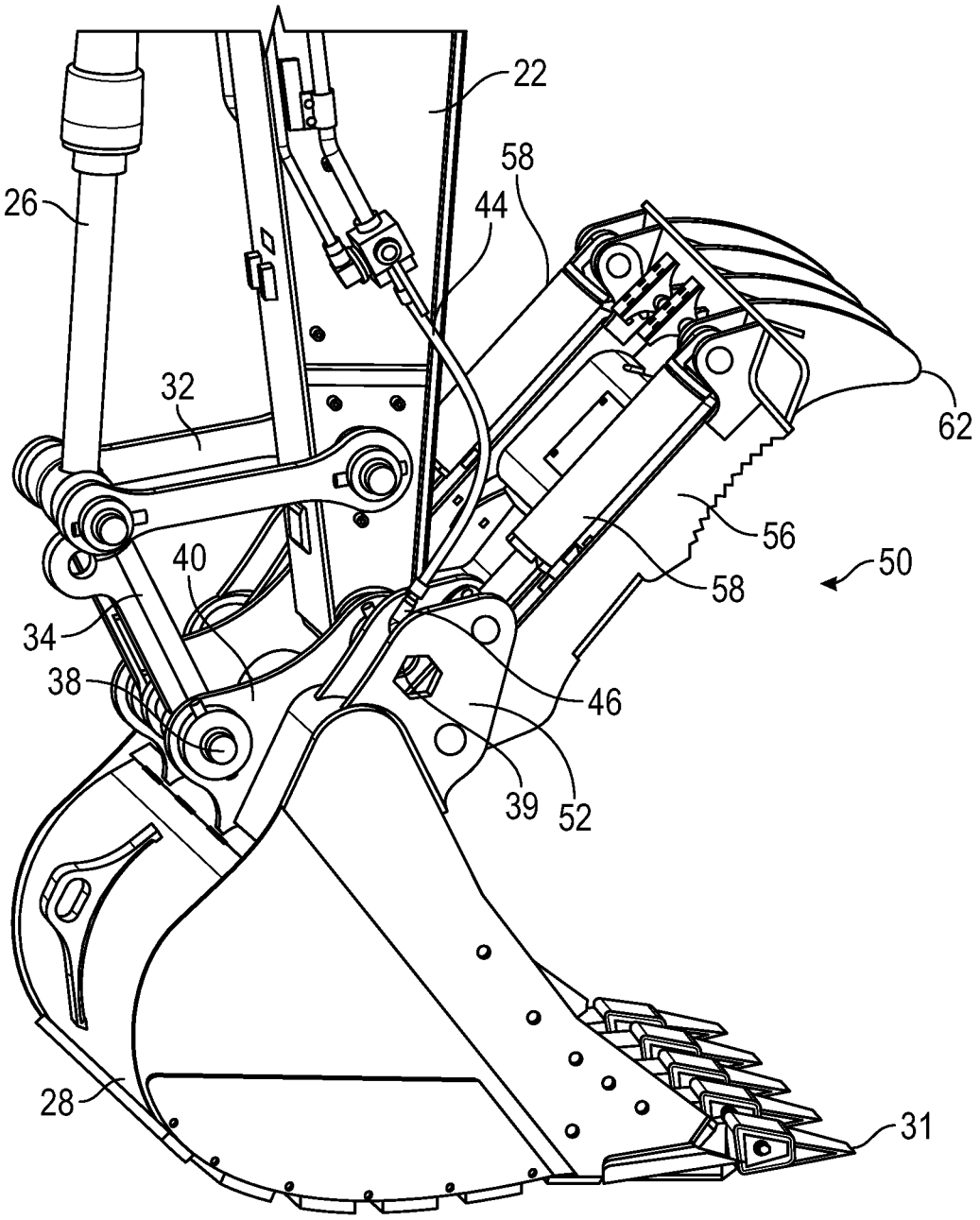
FIG. 4 is a perspective view of a back side of the thumb apparatus of the present disclosure mounted on a bucket pinned directly to a stick of an excavator.

Referring now to FIG. 4, in another example, the thumb apparatus 50 may be utilized with a bucket 28 directly pinned to the stick 22 via the power linkage pins 38, 39 in the hinge plate 40. An intermediate quick coupler is thus not required to mount the bucket 28 including the thumb apparatus 50 to a stick.

Referring now to FIGS. 5A-5D, an excavator bucket apparatus 100 includes a bucket 128 having mounted thereon a thumb apparatus 150, which is shown in a closed position. The bucket 128 includes a bottom section 170 and a curved heel section 172. A back side 171 of the curved heel section 172 may optionally include a heel wear plate 173 and a lifting hook 175. Substantially normal to the bottom section 170 and heel section 172 are opposed side sections 174 and 176, which include corresponding side plates 178, 180. The side plates 178, 180 are positioned on a front side of the bucket 128 proximal the ground engaging bottom section 170. Either or both of the side sections 174, 176 may optionally include side wear plates 177.

The bottom section 170 includes a base edge member 179 on which are mounted an arrangement of ground engaging elements 131 including, but not limited to, adapters, tips, and base edge protectors, and the like, which are commonly referred to as ground engaging tools. Different basic bucket elements and structure may be used to form the bucket 128, as will be apparent to those of ordinary skill in the art.

Joining the heel section 172 and the side sections 174, 176 is a top member 182, which is sometimes referred to as a hinge assembly. The top member 182 includes a rear edge 181 and a front edge 183. As shown in FIGS. 5A-5D, the front edge 183 of the top member 182 is on the same side of the bucket 128 as the base edge member 179 and the ground engaging tools 131. The rear edge 181 of the top member 182 is on the same side of the bucket 128 to which the power is applied by the hydraulic cylinders of the stick on which the bucket 128 is configured to be mounted.

In the example of FIGS. 5A-5D, an interface member 106 includes a pair of hinge plates 140A, 140B attached to the top member 182. The hinge plates 140A, 140B extend along a direction substantially normal to a longitudinal axis 102 of the top member 182. The hinge plates 140A. 140B thus extend from the rear edge 181 of the top member 182 to the front edge 183 thereof. The hinge plate 140A includes two bores 141 and 143, and hinge plate 140B includes two bores 145 and 147. The bores 143 and 147, which are on the front edge 183 of the top member 182, are axially aligned and configured to engage a stick pin that passes through a corresponding aperture in the stick of an excavator (see, for example, stick pin 39 in FIGS. 3B and 4). The bores 141 and 145 are axially aligned and are configured to engage a linkage pin that passes through the power link of the excavator (see, for example, power linkage pin 38 in FIGS. 3B and 4) such that the linkage pin articulating in the bores 141 and 145 exerts force on the back edge 181 of the top member 182 and causes the curling motion of the bucket 128 about the stick pin articulating in the bores 143 and 147. Thus, the hinge plates 140A. 140B form two sets of two axially aligned bores (141 and 145 form a first set of two axially aligned bores, and 143 and 147 form a second set of two axially aligned bores).

Elements of the top member 182 cooperate to form a torque tube 190. The torque tube 190 is designed to transfer torque from its middle section to its ends. The torque tube 190 functions to transfer "curling" torque about the center of the stick pin created by the power linkage pin, to the side sections 174, 176, corresponding side plates 178, 180, and the rest of the bucket 128. When the bucket bottom section 170 penetrates into material, the force propelling the bottom section 170 is transferred to the base edge 170 in part by this torsional force created about the stick pin by the power link.

In addition to torque, a variety of other load paths exist through the torque tube 190. The torque tube 190 must be capable of transferring all of these large sustained and shock loads and torques. The torque tube 190 is formed in part through joining the top member 182, bottom section 170, and hinge plates 140A, 140B to form a rigid, tube-like structure.

The hydraulic thumb assembly 150 includes an arrangement of flanges 152A-152D that are mounted on the front edge 183 of the top member 182 and extend along a direction substantially normal to the longitudinal axis 102 of the top member 182. The flanges 152A, 152B are arranged parallel to each other and are attached on a first end 185 of the top member 182 outboard of the hinge plate 140A. The flanges 152C, 152D are arranged parallel to each other and are attached on a second end 187 of the top member 182 outboard of the hinge plate 140B. The flanges 152A-152D each include apertures 191, axially aligned with the bores 143, 147 of the hinge plates 140A, 140B, which can be used to access the stick pin (not shown in FIGS. 5A-5D) within the bores 143, 147.

Figure 5A:
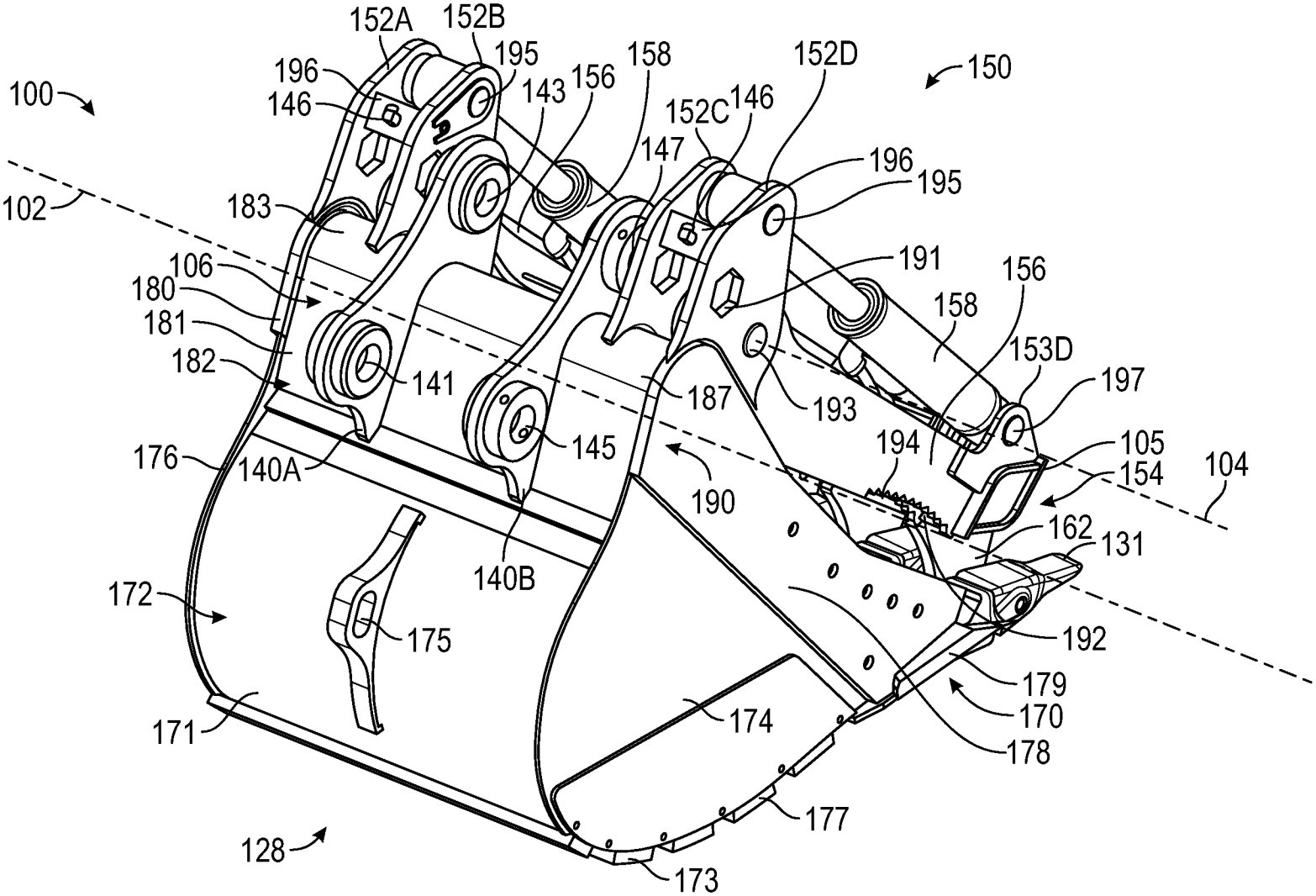
FIG. 5A is a perspective view of a back side of an embodiment of the thumb apparatus of the present disclosure mounted on an excavator bucket, wherein the thumb apparatus is in a closed position.
Figure 5B:
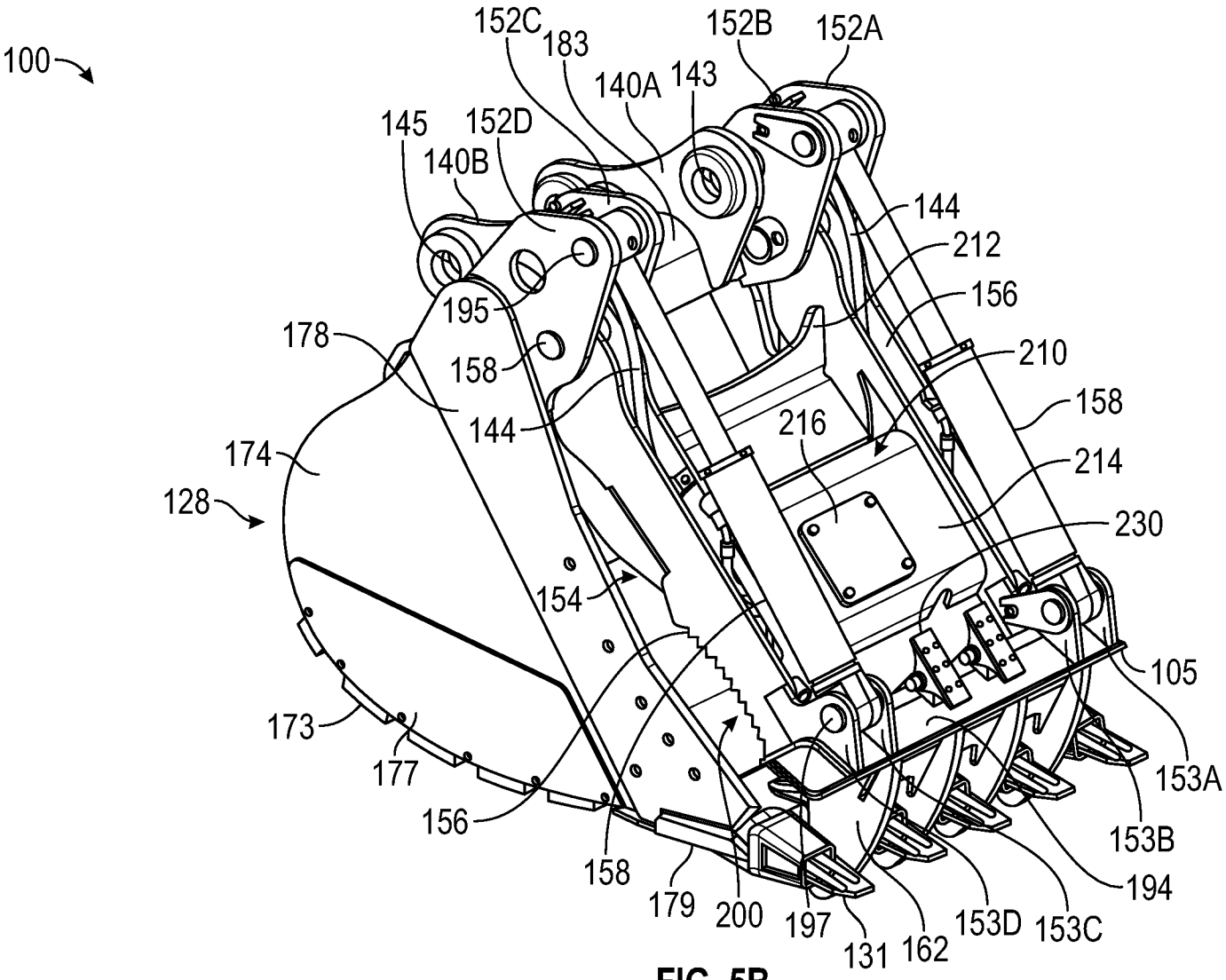
FIG. 5B is a perspective view of a front side of an embodiment of the thumb apparatus of FIG. 5A.
Figure 5C:
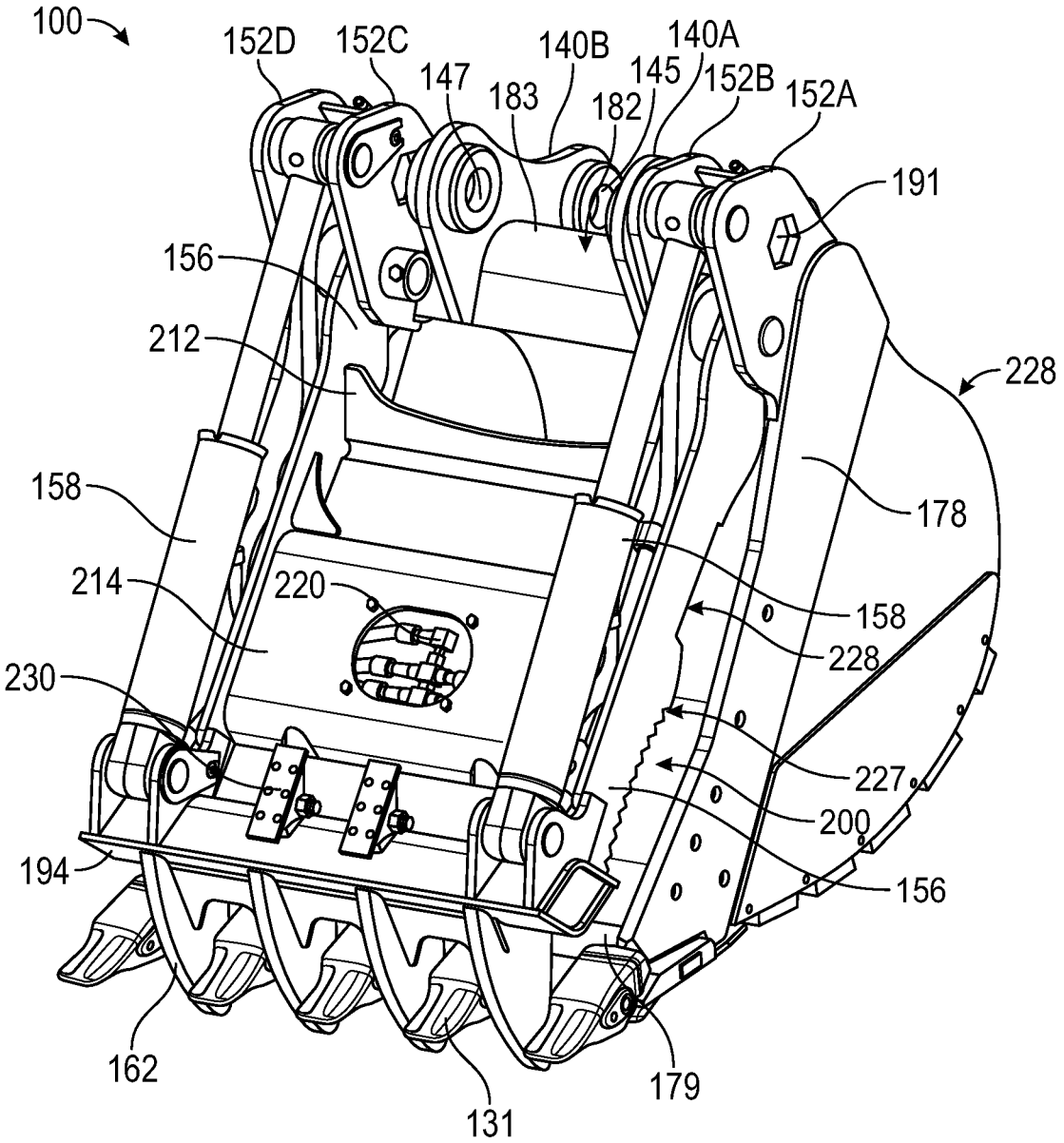
FIG. 5C is a perspective view of a front side of the thumb apparatus of FIG. 5B.
Figure 5D:
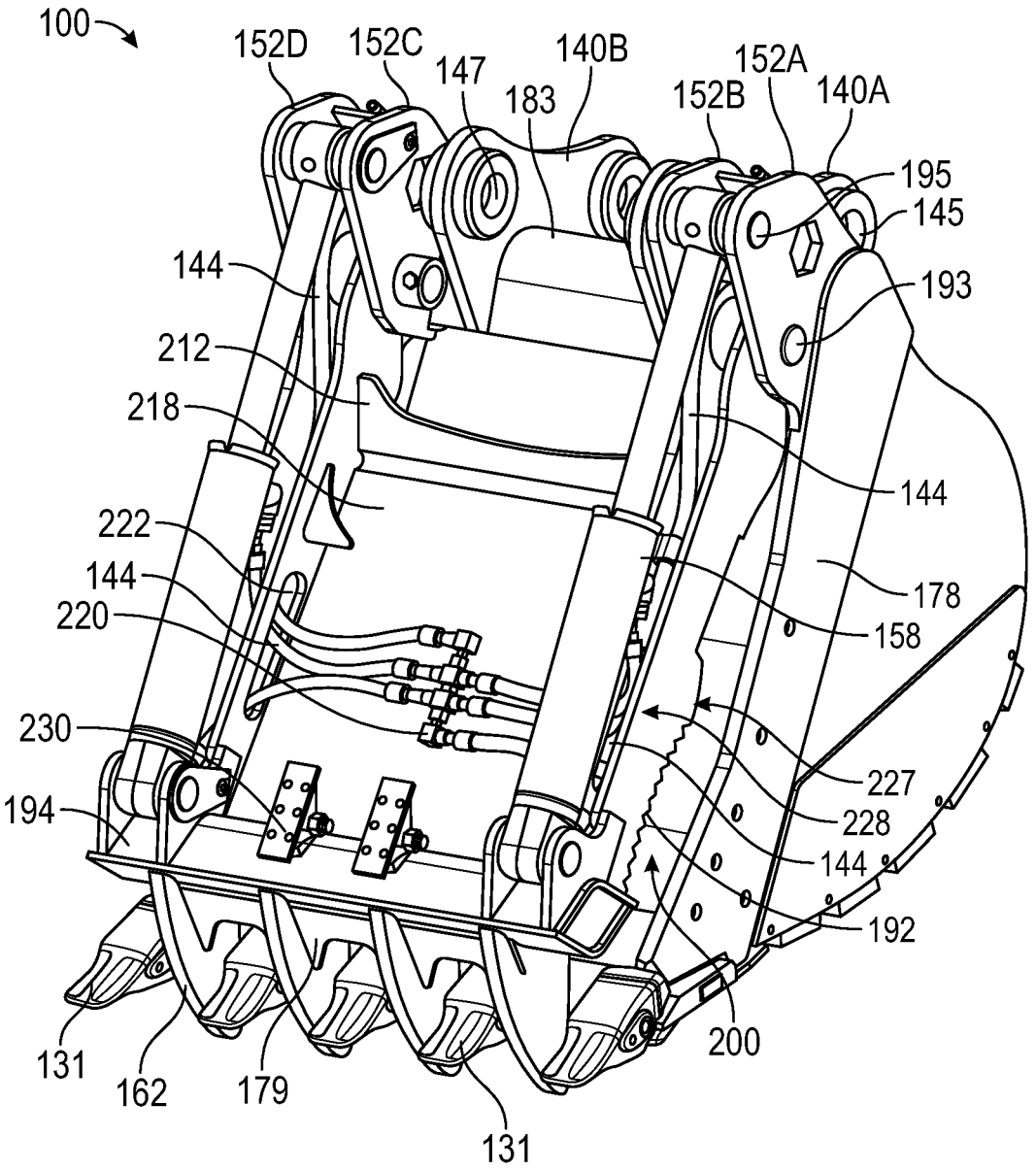
FIG. 5D is a perspective view of a front side of an embodiment of the thumb apparatus of FIG. 5A.
Figure 5E:
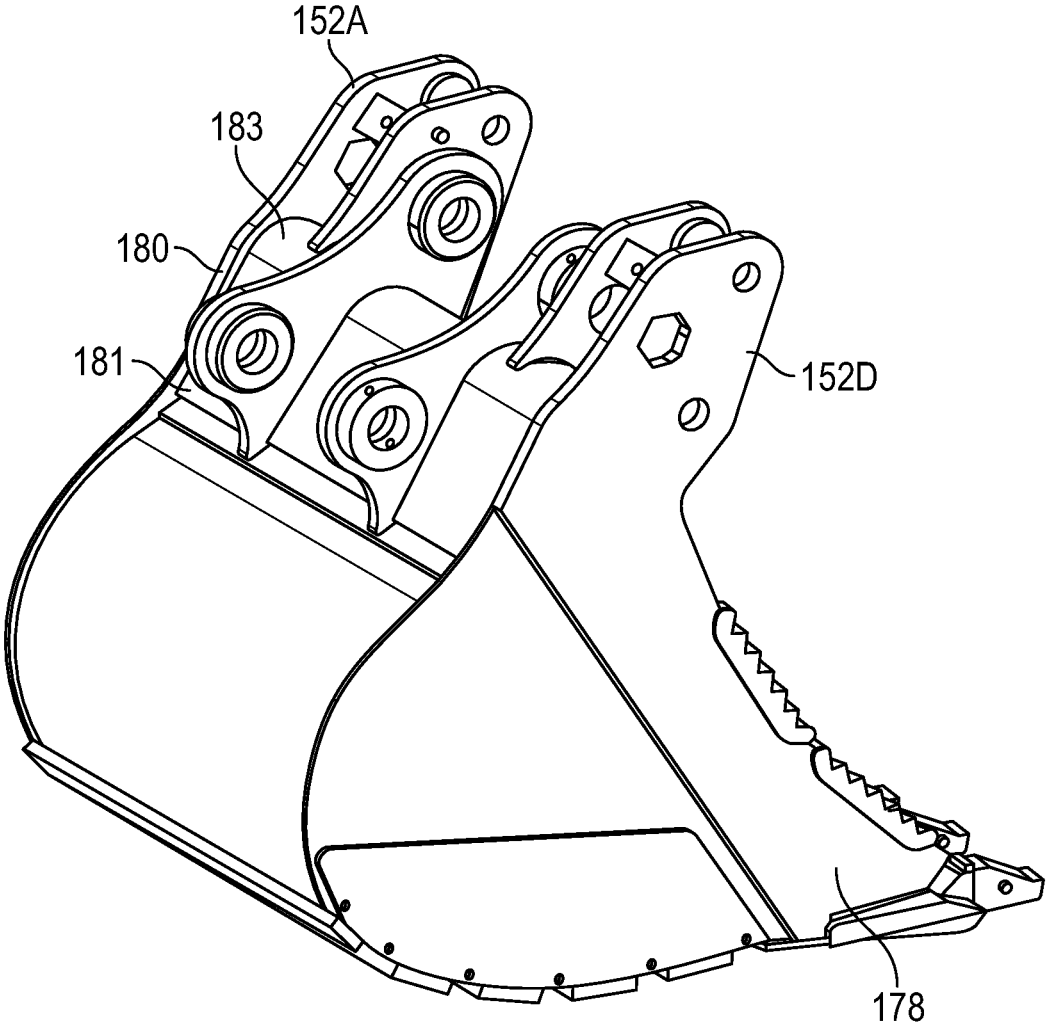
FIG. 5E is a perspective view of a back side of an excavator bucket, which shows thumb apparatus mounting flanges integral with the bucket side plates.

As shown in FIGS. 5A-5D, the outboard flanges 152A, 152D are mounted directly on the side plates 180, 178, respectively. However, the flanges 152A-D may be mounted at any position on the front edge 183 of the top member 182. As shown in the example of FIG. 5E, the outboard flanges 152A, 152D are integral to the respective side plates 180, 178.

The outboard flanges 152A, 152D include pins 193 attaching a frame 154 thereto such that arms 156 can articulate about an axis 104 with respect to the top member 182. As shown in FIGS. 5A-5D, the axis 104 is substantially parallel to the longitudinal axis 102 of the top member 182. A lower portion 227 of the arms 156 can optionally include gripping elements such as, for example, teeth or serrations 192, such that the arms 156 can more readily engage with and retain objects within an interior 200 of the bucket 128.

The paired flanges 152A, 152B and 152C, 152D include pins 195 for mounting linear actuators such as, for example, hydraulic cylinders 158. However, it should be understood that other types of actuators can be used such as, for example, electrical, mechanical/electro-mechanical, pneumatic piezoelectric, and the like, as well as combinations thereof. The hydraulic cylinders 158 attach to corresponding pins 197 within flanges 153A-D on a distal end 105 of the arms 156 such that the cylinders 158, when activated, can move the frame 154 with respect to the bucket 128. As shown in FIGS. 5B-5D, the arms 156 are mounted in the flanges 152A-152B and 152C-152D such that the arms articulate inboard of the side plates 176, 178 as the frame 154 moves from an open position to a closed position.

The distal end 105 of the frame 154 further includes a transverse crossmember 194 mounting protruding elements 162, which, when the thumb apparatus 150 moves into a closed position, extend between the ground engaging elements 131 on the bottom edge 179 of the bucket 128 such that the crossmember 194 is urged against the base edge member 179 of the bottom section 170.

As further illustrated in FIGS. 5A-5D, in some examples the flanges 152A-152D can include reinforcing crossmembers 196, which in some examples can also include mounts for hydraulic fittings 146.

As shown more clearly in FIGS. 5B-5D, the frame 154 includes an arrangement of crossmembers 210 extending along a direction normal to the arms 156. In some examples, the crossmembers 210 include one or more reinforcing ribs 212 extending normal to and between the substantially parallel to the arms 156. As shown in FIG. 5B, in some examples, the crossmembers 210 include a housing 214 extending between the arms 156. The housing 214 may optionally include a removable cover 216 providing access to hydraulic fittings 220 retained within the housing 214.

In another example shown in FIG. 5D, the crossmembers 210 can including a substantially planar plate 218 extending normal to and between the parallel arms 156. In some examples, at least one of the arms 156 can optionally include an elongate opening 222 extending along a direction parallel to the arms 156. Hydraulic lines 144 are routed through the opening 222 for connection to the hydraulic fittings 220 mounted on the plate 218. Although not shown in FIGS. 5A-5D, in some examples the openings 222 can optionally be used to route the hydraulic lines 144 into the housing 214.

In some examples, an upper portion 228 of the frame 154 can also optionally include one or more elastomeric bumpers 230 to prevent the frame 154 from forcefully contacting a stick attached to the bucket 128 when the frame 154 is in a fully open position. The shape and size of the bumpers 230 may vary widely, and those illustrated in FIGS. 5A-5D are merely provided as an example.

Figure 6A:
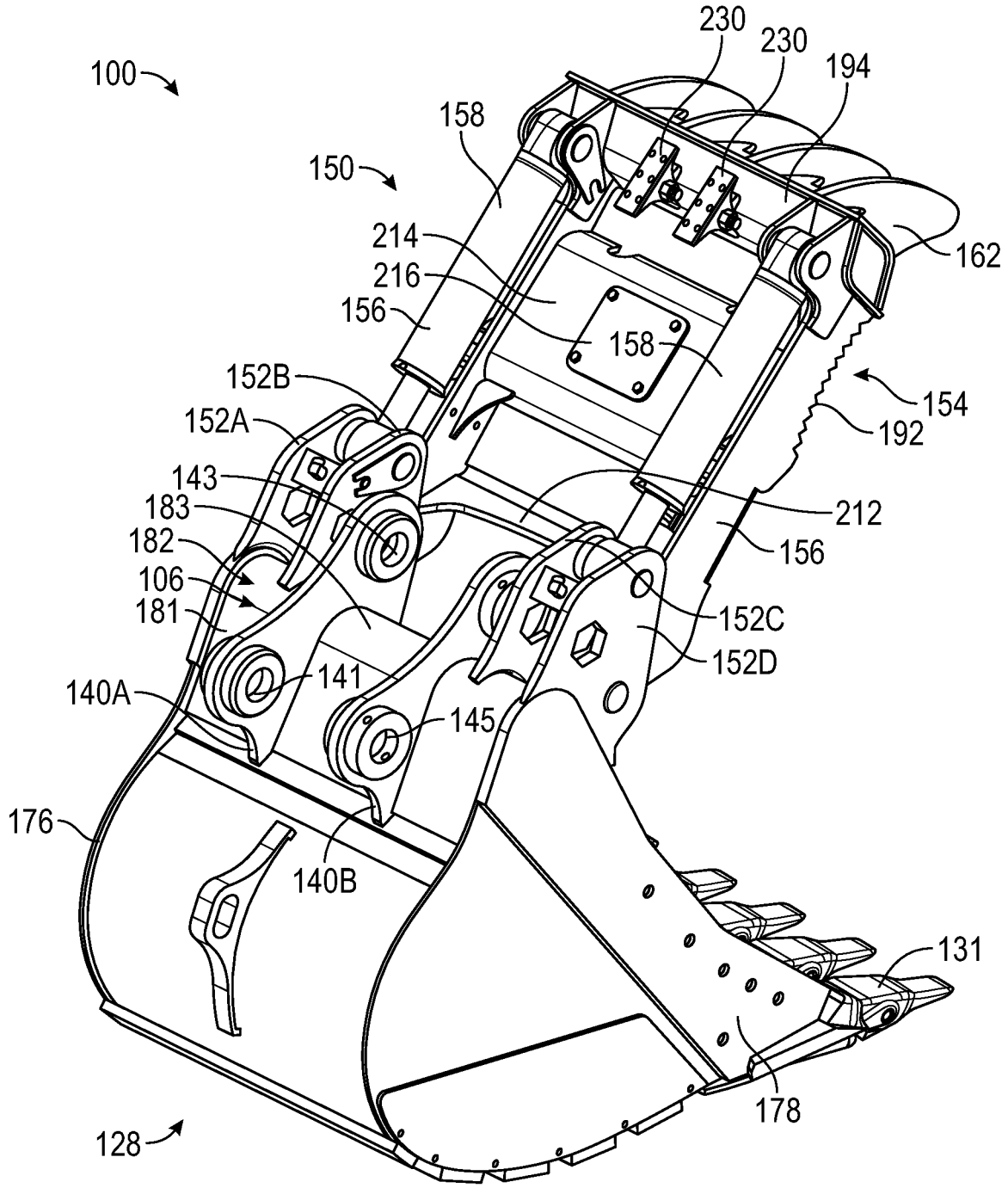
FIG. 6A is a perspective view of a back side of an embodiment of the thumb apparatus of the present disclosure mounted on an excavator bucket, wherein the thumb apparatus is in an open position.
Figure 6B:
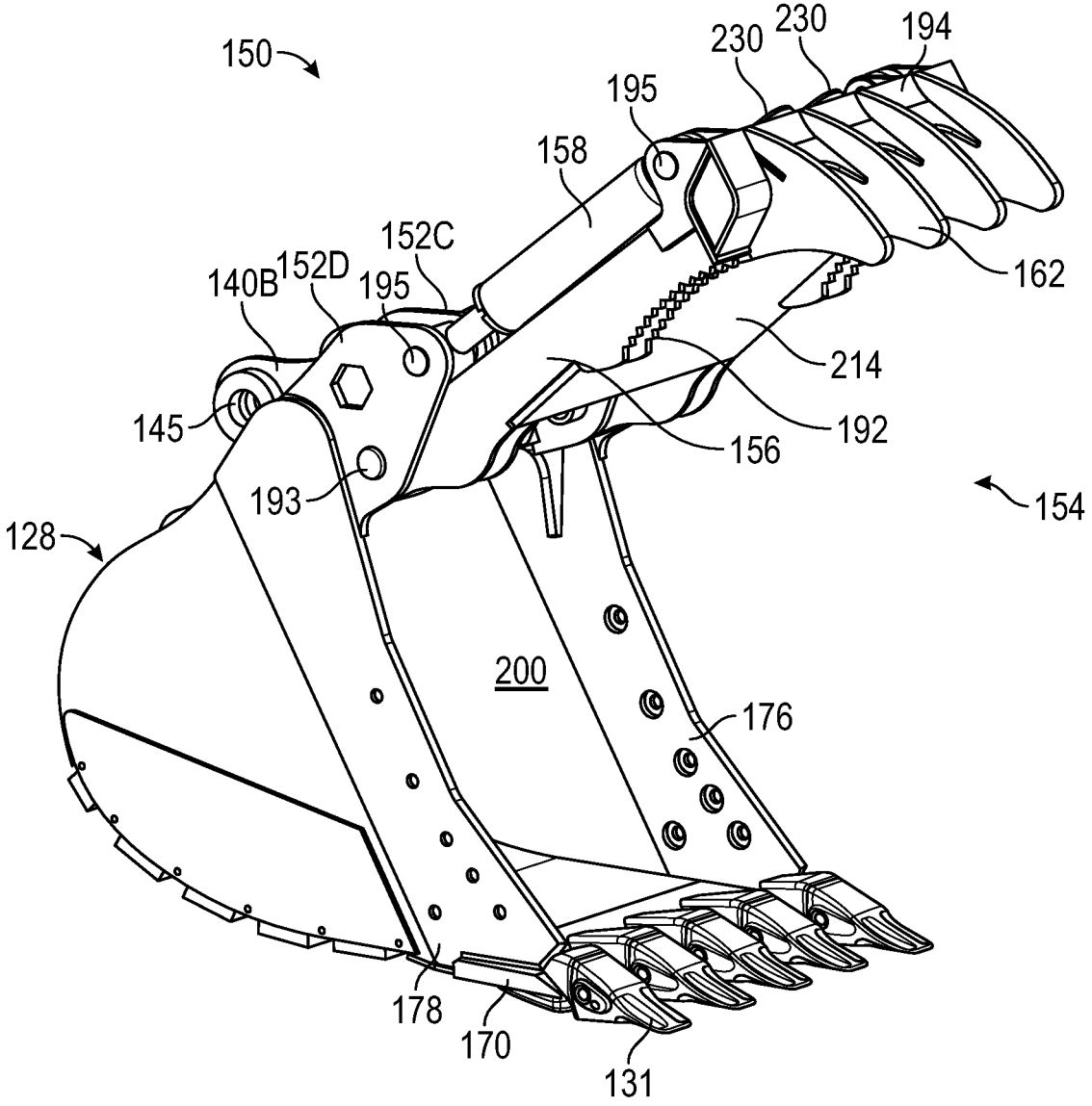
FIG. 6B is a perspective view of a front side of an embodiment of the thumb apparatus of FIG. 6A.

FIGS. 6A-6B show the thumb apparatus 150 in a fully open position. As shown in FIGS. 6A-6B, the thumb apparatus 150, when open, allows the attached bucket 128 to move from a fully retracted position to a fully extended position. As the frame 154 moves from the open position to the closed position, the arms 156 move inboard of the side plates 176, 178 so that the gripping elements 192 on the arms 156 can engage bulky materials retained within the interior 200 of the bucket 128.

Figure 7A:
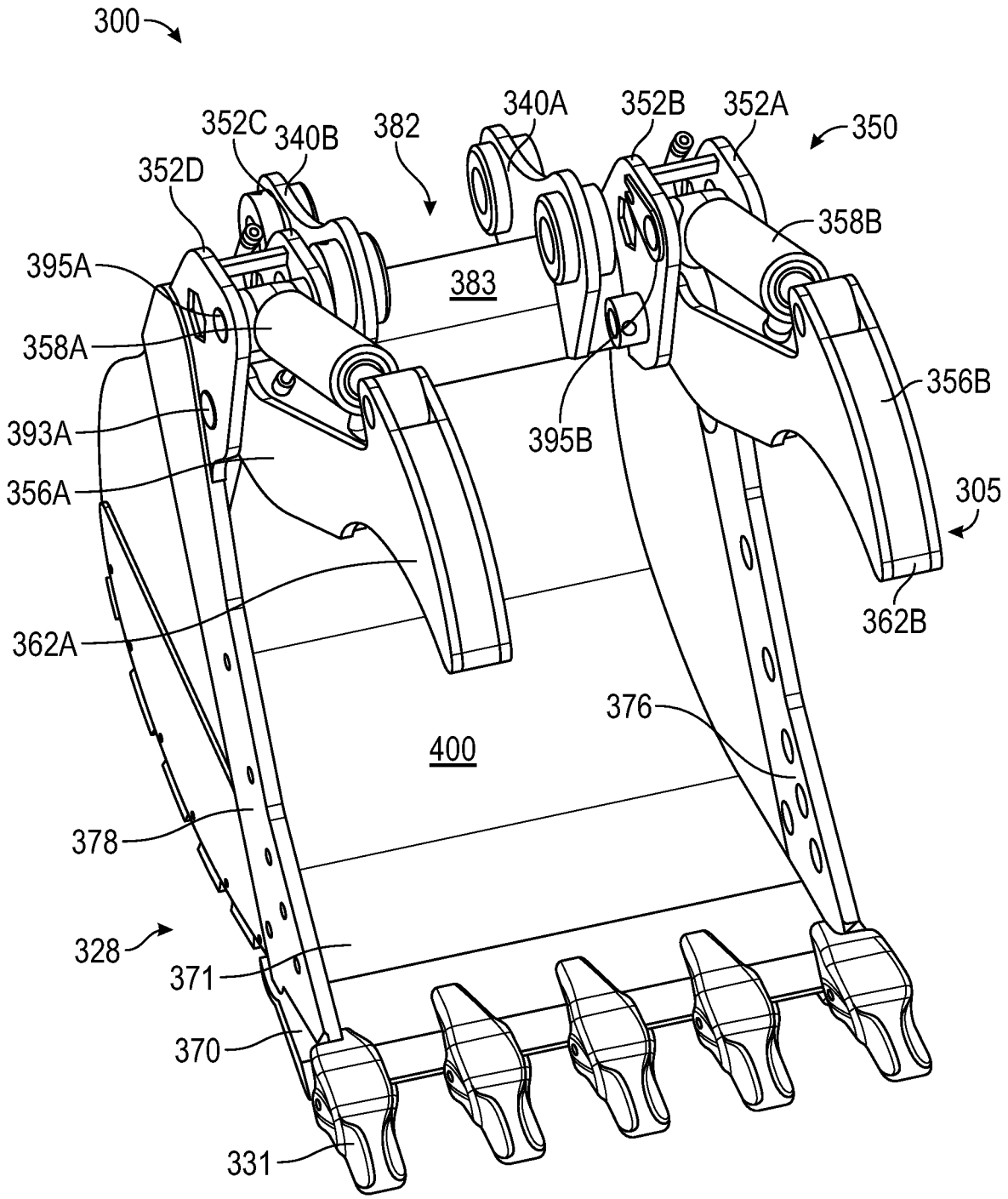
FIG. 7A is a perspective view of a front side of an embodiment of the thumb apparatus of the present disclosure mounted on an excavator bucket, wherein the thumb apparatus is in an open position.
Figure 7B:
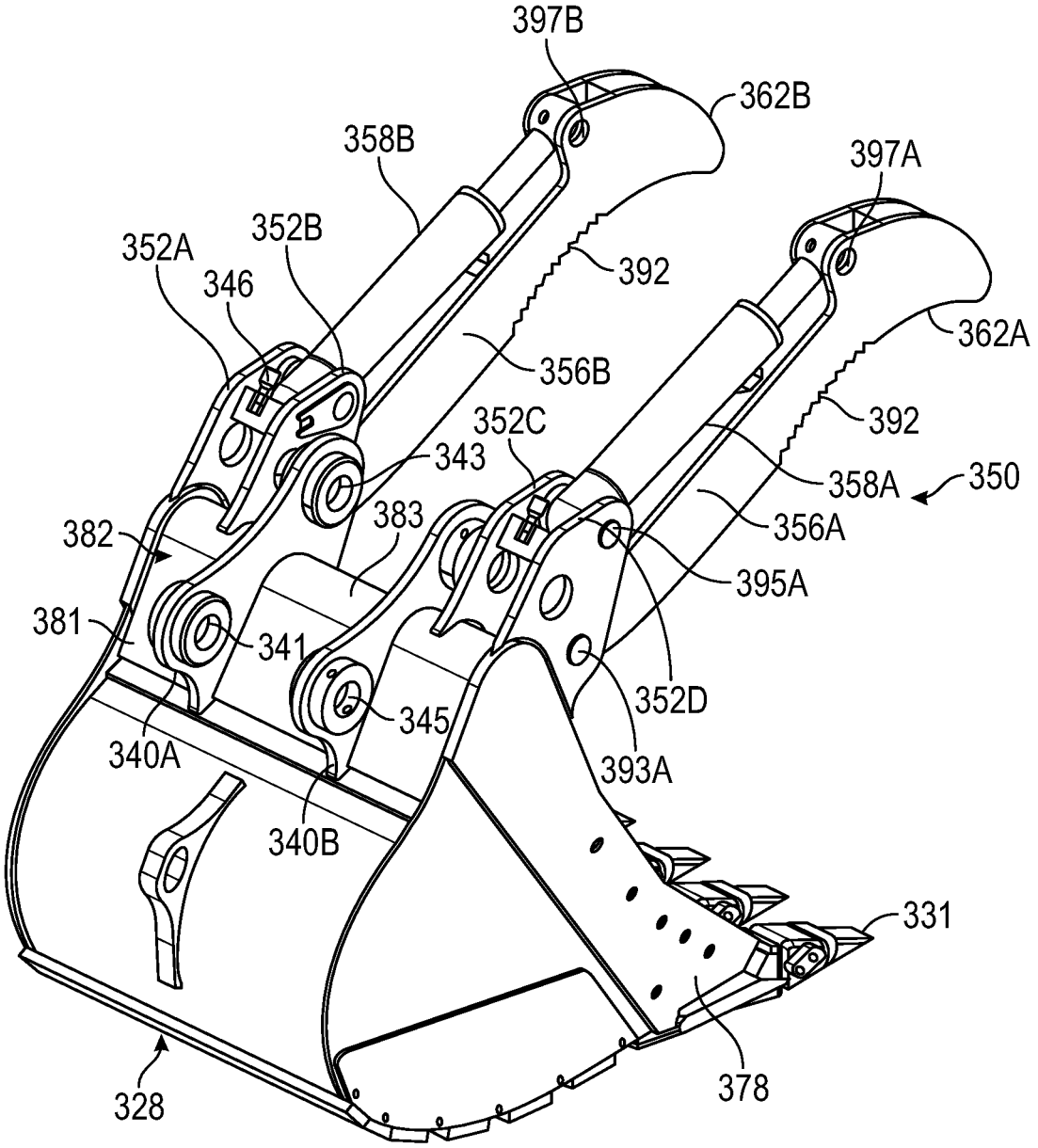
FIG. 7B is a perspective view of a back side of an embodiment of the thumb apparatus of FIG. 7A.

Referring now to FIGS. 7A-7B, in another embodiment a bucket apparatus 300 includes a thumb apparatus 350 mounted on a bucket 328 and in an open position. The thumb apparatus 350 includes a pair of substantially parallel arms 356A, 356B. The arm 356A is mounted in flanges 352C, 352D, and the arm 356B is mounted in flanges 352B, 352A, with the flanges 352A-D being attached to the front edge 383 of the top member 382. Since the arms 356A, 356B include no crossmember between them, the arms 356A, 356B are independently moveable about respective pins 393A, 395A, 393B, 395B in the flanges 352A-D using respective hydraulic cylinders 358A, 358B. In addition, the arms 356A, 356B may include protruding elements 362A. 362B on a distal end 305, and the protruding elements 362A, 362B may be the same or different. In some examples, one or both of the arms 356A, 356B may optionally include gripping elements 392.

Figure 8A:
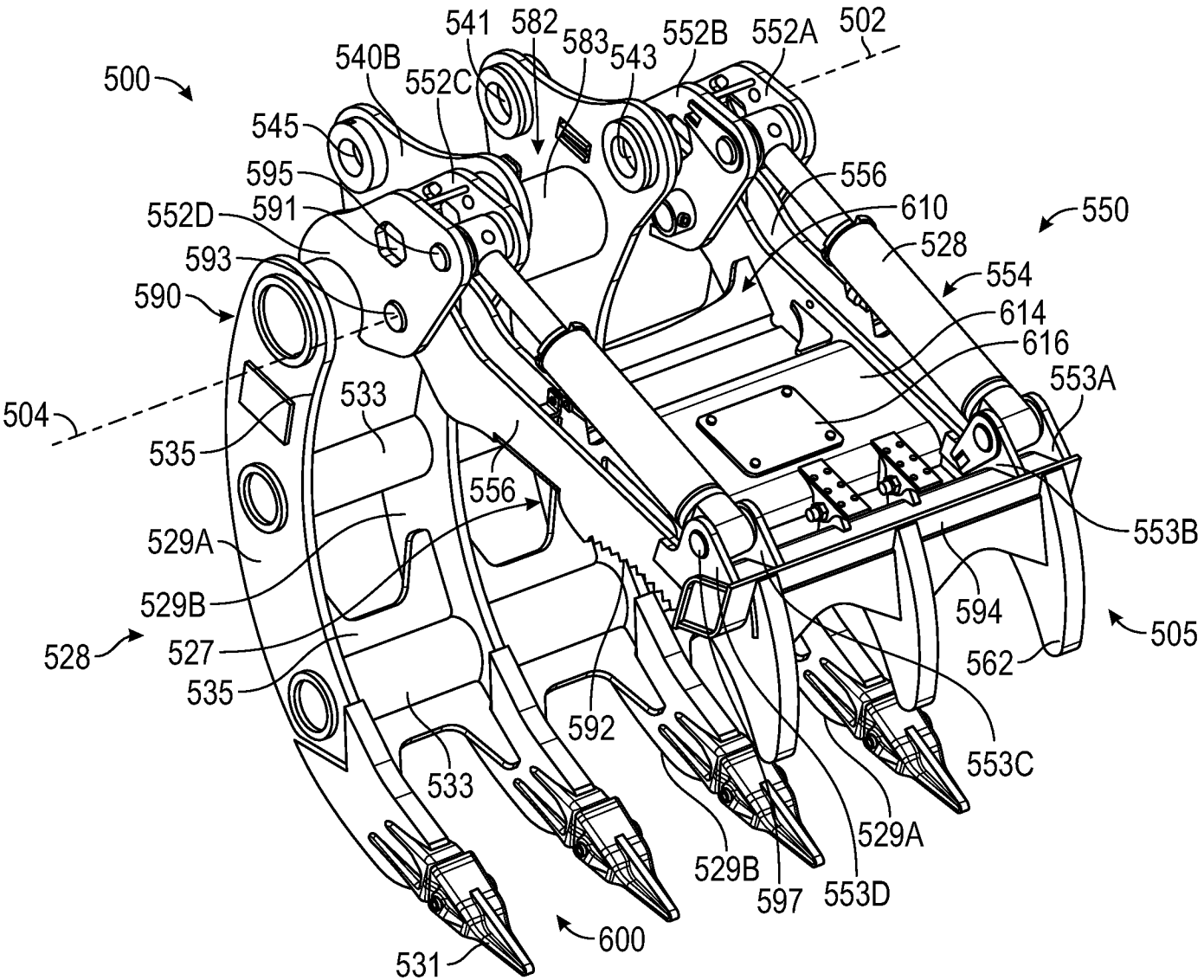
FIG. 8A is a perspective view of a front side of an embodiment of the thumb apparatus of the present disclosure mounted on a rake tool, wherein the thumb apparatus is in an open position.
Figure 8B:
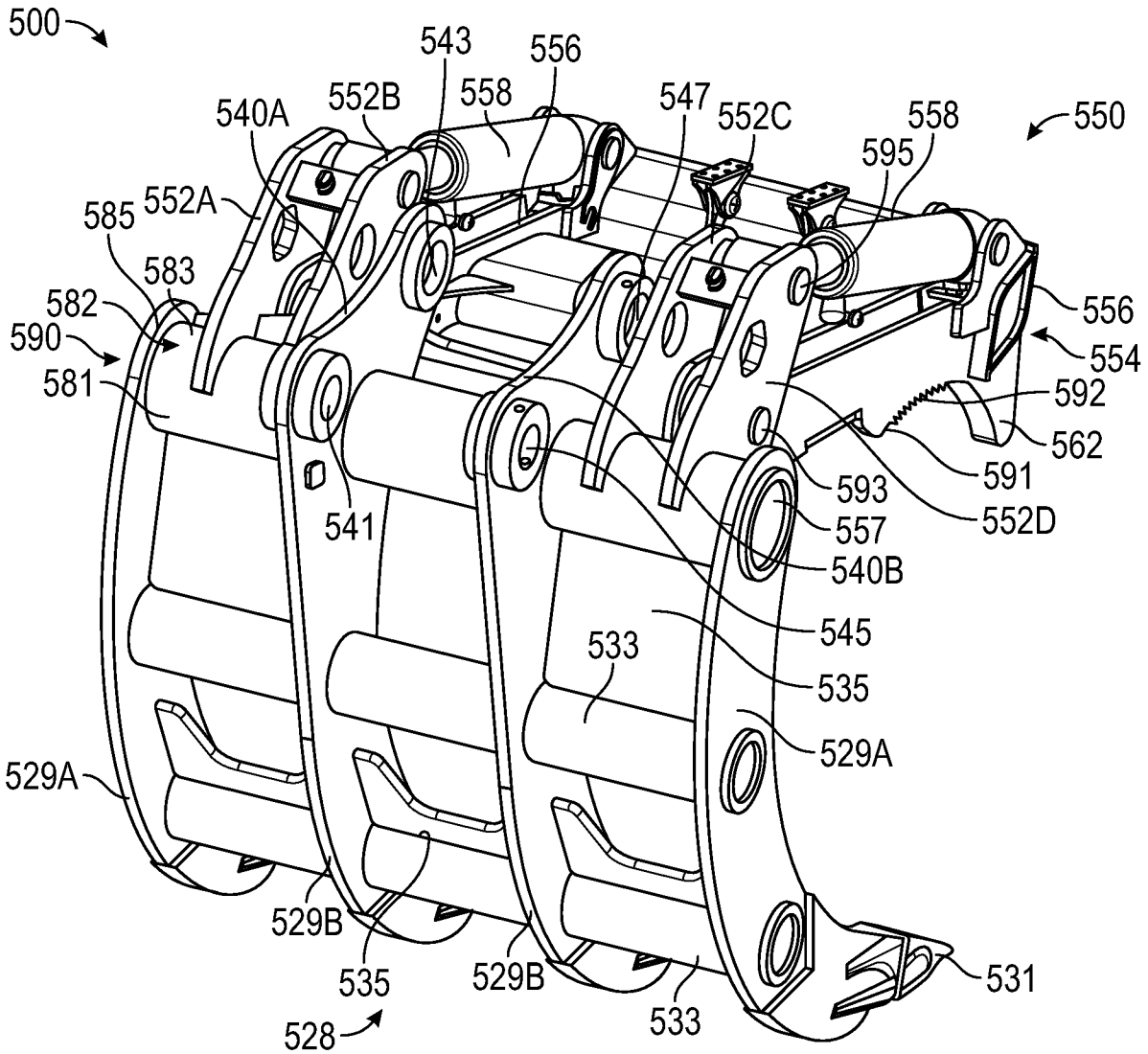
FIG. 8B is a perspective view of a back side of an embodiment of the thumb apparatus of FIG. 8A.

As shown in FIGS. 8A-8B, the ground engaging tool to which the thumb apparatus may be mounted may vary widely, and is not limited to excavator buckets. In the example of FIG. 8, a rake apparatus 500 includes a rake assembly 528 having mounted thereon a thumb apparatus 550, which is shown in an open position.

The rake assembly 528 includes an arrangement of outboard arcuate arms 529A and inboard arcuate arms 529B, each terminating in ground engaging tines 531. The arcuate arms 529A, 529B may optionally including reinforcing crossmembers 533 and side plates 535 extending generally normal thereto. The arcuate The rake assembly 528 is attached to a top member 582, which includes a rear edge 581 and a front edge 583. As shown in FIGS. 8A-8B, the front edge 583 of the top member 582 is on the same side of the rake assembly 528 as the ground engaging tines 531. The rear edge 581 of the top member 582 is on the same side of the rake assembly 528 to which the power is applied by the hydraulic cylinders of the stick on which the rake assembly 528 is mounted.

The inboard arms 529B include interface members such as hinge plate portions 540A, 540B, which are attached to the top member 582 and extend along a direction substantially normal to a longitudinal axis 502 of the top member 582. The hinge plate portions 540A, 540B thus extend from the rear edge 581 of the top member 582 to the front edge 583 thereof. The hinge plate portion 540A includes two bores 541 and 543, and hinge plate portion 540B includes two bores 545 and 547. The bores 543 and 547, which are on the front edge 583 of the top member 582, are axially aligned and are configured to engage a stick pin that passes through a corresponding aperture in the stick of an excavator (see, for example, stick pin 39 in FIGS. 3B and 4). The bores 541 and 545 are axially aligned and are configured to engage a linkage pin that passes through the power link of the excavator (see, for example, power pin 38 in FIGS. 3B and 4) such that the linkage pin articulating in the bores 541 and 545 exerts force on the back edge 581 of the top member 582 and causes the curling motion of the rake apparatus 528 about the stick pin articulating in the bores 543 and 547.

Elements of the top member 582 cooperate to form a torque tube 590, which transfers torque from its middle section to its ends. The torque tube 590 functions to transfer "curling" torque about the center of the stick pin created by the power linkage pin, to the arms 529A. 529B of the rake assembly 528. When the tines 531 on the arms 529A, 529B penetrate into material, the force propelling the tines is transferred to the crossmembers 533 in part by the torsional forces created about the stick pin by the power link. The torque tube 590 thus joins the top member 582, hinge portions 540A, 540B, arms 529A, 529B, crossmembers 533, and reinforcing side plates 535 to form a rigid, tube-like structure.

The thumb apparatus 550 includes an arrangement of flanges 552A-552D that are attached to the front edge 583 of the top member 582 and extend along a direction substantially normal to the longitudinal axis 502 of the top member 582. The flanges 552A, 552B are arranged substantially parallel to each other and are attached on a first end 585 of the top member 582 outboard of the hinge plate portion 540A. The flanges 552C. 552D are arranged parallel to each other and are attached on a second end 587 of the top member 182 outboard of the hinge plate portion 540B. The flanges 552A-552D each include apertures 591, axially aligned with the bores 543, 547 of the hinge plates 540A. 540B, which can be used to access the stick pin (not shown in FIGS. 8A-8B) within the bores 543, 547.

The outboard flanges 552A, 552D include pins 593 attaching a frame 554 thereto such that arms 556 can articulate about an axis 504 with respect to the top member 582. As shown in FIGS. 8A-8B, the axis 504 is substantially parallel to the longitudinal axis 502 of the top member 582. A lower portion 527 of the arms 556 can optionally include gripping elements such as, for example, teeth or serrations 592, such that the arms 556 can more readily engage with and retain objects within an interior region 600 of the rake apparatus 528.

The paired flanges 552A, 552B and 552C, 552D include pins 595 for mounting actuators such as hydraulic cylinders 558. The hydraulic cylinders 558 attach to corresponding pins 597 within flanges 553A-D on a distal end 505 of the arms 556 such that the cylinders 558, when activated, can move the frame 554 with respect to the rake assembly 528. The arms 556 are mounted in the flanges 552A-552B and 552C-552D such that the arms articulate inboard of the outboard arms 529A as the frame 554 moves from an open position to a closed position.

The distal end 505 of the frame 554 further includes a crossmember 594 mounting protruding elements 562, which, when the thumb apparatus 550 moves into a closed position, extend between the ground engaging tines 531 on the rake assembly 528 such that the crossmember 594 is urged against the crossmember 533.

As discussed above with respect to the embodiments shown in FIGS. 5B-5D, the frame 554 includes an arrangement of crossmembers 610 extending normal to and between the substantially parallel to the arms 556. As shown in FIGS. 8A-8B, in some examples, the crossmembers 610 include a housing 614 extending between the arms 556. The housing 614 may optionally include a removable cover 616 providing access to hydraulic fittings (not shown in FIGS. 8A-8B) retained within the housing 614.

Figure 9:
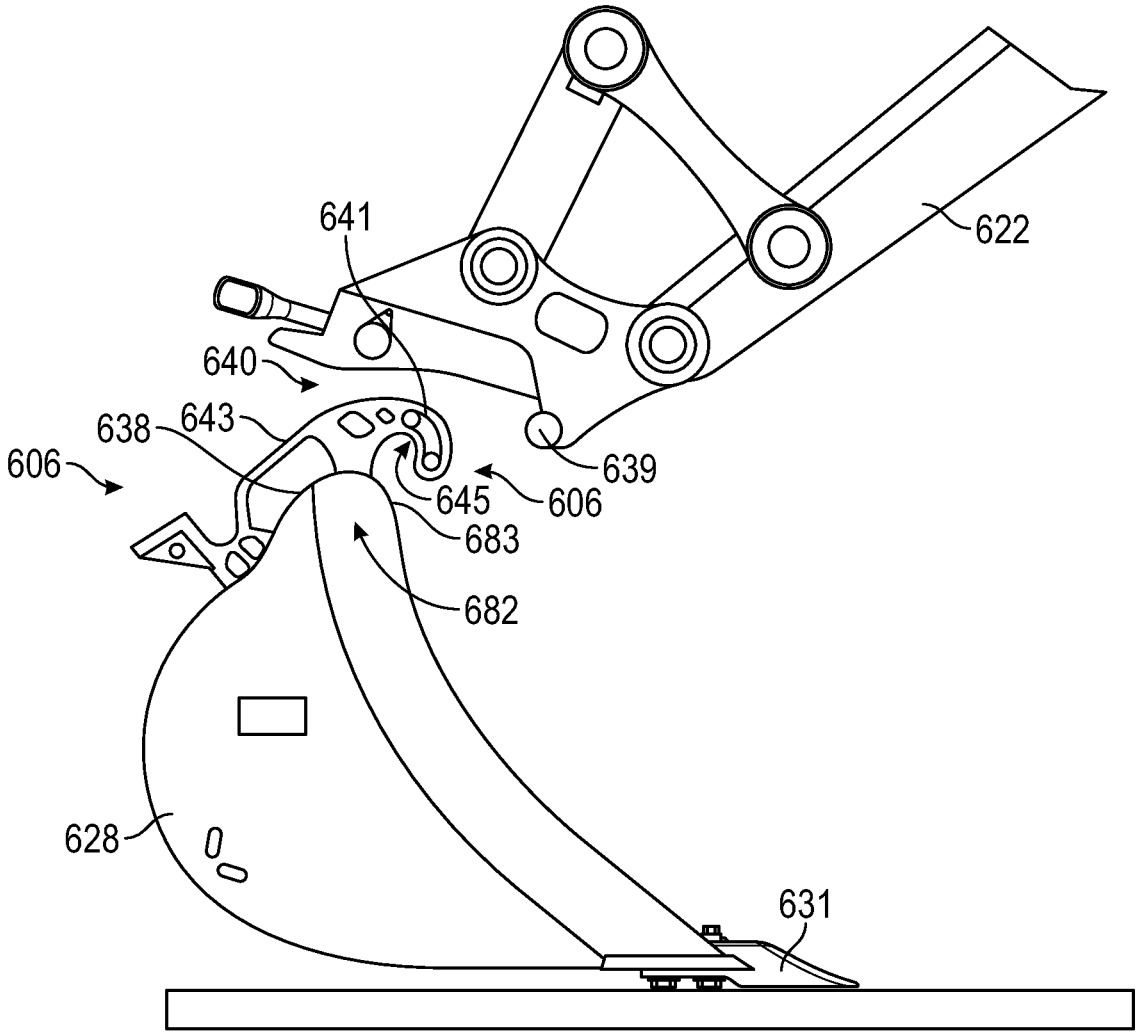
FIG. 9 is a perspective view of an embodiment of an interface member suitable for use with the thumb apparatus of the present disclosure.

The interface member may be configured in a wide variety of ways. To provide another example, FIG. 9 is a schematic representation of an interface member 606 that extends from a rear edge 681 to a front edge 683 of a top member 682. As shown in FIG. 9, the front edge 683 of the top member 682 is on the same side of a bucket 628 as ground engaging tools 631. The rear edge 681 of the top member 682 is on the same side of the bucket 628 to which the power is applied by the stick 622 on which the bucket 628 is configured to be mounted.

In the example of FIG. 9, the interface member 606 includes a hook member 640 attached to the top member 682. The hook member 640 extends from the rear edge 681 of the top member 682 to the front edge 683 thereof. The hook member 640 includes a hook portion 641 extending forward of the front edge 683 of the top member 682, as well as a hook mounting portion 643 extending along the rear edge 681 of the top member 682. The hook portion 641 includes an arcuate engagement surface 645 that is configured to engage a stick pin 639 that passes through a corresponding aperture in the stick 622. The stick pin 639 articulates in the arcuate engagement surface 645 to exert force on the hook portion 641, which is transferred to the back edge 681 of the top member 682 by the hook mounting portion 643. The back edge 681 of the top member 682 causes the curling motion of the bucket 628 about the stick pin 639 articulating in the arcuate engagement surface 645.

In another embodiment, the present disclosure is directed to a universal thumb apparatus kit that may be quickly and easily mounted to a torque tube or other torque transferring member on a wide variety of existing ground engaging tools. In some examples the universal thumb apparatus kit can include a mount with a plurality of flanges configured for attachment to the torque tube on the ground engaging tool. The kit further includes a frame configured to be attached to the mount, and the frame can include one or more arms configured to be attached to the flanges. The kit further includes fittings that can be connected to actuators such as, for example, hydraulic cylinders, configured to articulate the one or more arms on the frame, as well as suitable hydraulic or electrical lines needed to attach the thumb apparatus to a tool.

In another aspect, the present disclosure is directed to a method including attaching a thumb apparatus to a front edge of a top member configured to transfer torque to a ground engaging tool. The thumb apparatus includes a mount, at least one arm attached to the mount, and at least one actuator attached to the arm and the mount.

INDUSTRIAL APPLICABILITY

The foregoing thumb assembly may be used in the construction of ground engaging tools such as buckets and rakes configured for attachment to machines such as excavators, tractors, backhoes, skid-steer loaders and the like for use in many industries including construction and mining.

EXAMPLES

Example A. An apparatus, comprising:

a top assembly comprising a top member with a front edge and a back edge, wherein the top assembly is attached to a ground engaging tool;

a thumb assembly attached to the top member, the thumb assembly comprising:

a mount extending from the front edge of the top member, at least one arm attached to the mount; and at least one actuator attached to the mount and the at least one arm, wherein the actuator is configured to move the at least one arm with respect to the ground engaging tool.

Example B. The apparatus of Example A, wherein the top member comprises an interface assembly having a first hinge plate and a second hinge plate attached to the top member, wherein the first hinge plate and the second hinge plate extend along a direction normal to a longitudinal axis of the top member.

Example C. The apparatus of Example B, wherein the first hinge plate and the second hinge plate each comprise a first bore overlying the front edge of the top member, and a second bore overlying the back edge of the top member, and wherein the respective first bores and second bores are axially aligned.

Example D. The apparatus of Example C, wherein the mount for the thumb assembly comprises first and second substantially parallel flanges attached to the top member and extending along the direction normal to the longitudinal axis of the top member, and wherein the first and second flanges are positioned outboard of the first hinge plate.

Example E. The apparatus of Example C, further comprising a side plate attached to a first end of the top member and extending along the direction normal to the longitudinal axis of the top member, wherein one of the first and the second flanges is attached to the side plate.

Example F. The apparatus of Examples D or E, wherein the mount further comprises third and fourth substantially parallel flanges extending along the direction normal to the longitudinal axis of the top member, and wherein the third and fourth flanges are positioned outboard of the second hinge plate.

Example G. The apparatus of any of Examples D to F, further comprising a second side plate attached to a second end of the top member and extending along the direction normal to the longitudinal axis of the top member, and wherein one of the third and fourth flanges is attached to the second side plate.

Example H. The apparatus of any of Examples A to G, wherein the thumb assembly comprises a first arm and a second arm, wherein the first arm and the second arm extend along a direction normal to the longitudinal axis of the top member, and wherein the first arm is substantially parallel to the second arm.

Example I. The apparatus of Example H, wherein a first end of the first arm and a first end of the second arm are attached to the mount, and a second end of the first arm and a second end of the second arm are attached a distal edge of a frame.

Example J. The apparatus of Example I, further comprising a first actuating member attached to the first mount and extending substantially parallel to the first arm of the frame, and a second actuating member attached to the second mount and extending substantially parallel to the second arm of the frame.

Example K. The apparatus of Example J, wherein the first actuating member and the second actuating member are independently chosen from electrical, mechanical, hydraulic, pneumatic, piezoelectric, and combinations thereof.

Example L. The apparatus of any of Examples F to K, wherein the first flange, the second flange, the third flange, and the fourth flange each comprise an aperture, and wherein the apertures in the first, second, third and fourth flanges are axially aligned with the first bores in the first hinge plate and the second hinge plate.

Example M. The apparatus of any of Examples G to L, further comprising a heel section attached to the first side plate, the second side plate, and a base portion of the ground engaging tool.

Example N. The apparatus of Example M, wherein the base portion comprises a cutting edge with an array of tines protruding therefrom.

Example O. The apparatus of Examples M or N, wherein the heel section has a first major surface proximal to the front edge of the top member and a second major surface proximal to the back edge of the top member, and wherein at least a portion of the second major surface is overlain by a protective shroud.

Example P. The apparatus of Example O, further comprising a lift eye on the second major surface of the heel section.

Example Q. The apparatus of any of Examples G to P, further comprising an arrangement of tines between the first side plate and the second side plate, wherein the tines extend from the top member to a base portion of the ground engaging tool.

Example R. The apparatus of Example Q, wherein the base portion of the ground engaging tool comprises an array of ground engaging elements on the tines.

Example S. A thumb apparatus, comprising:

a mount comprising an arrangement of flanges configured for attachment to a first surface of a torque tube of a ground engaging tool, wherein the first surface of the torque tube is opposed to a second surface to which power is applied to the torque tube;

a frame attached to the flanges, wherein the frame comprises a distal edge configured to engage with a ground-contacting base portion of the tool, and at least one actuator attached to the flanges and the frame, wherein the actuator is configured to move the frame with respect to the base portion of the tool.

Example T. The apparatus of Example S, wherein the frame comprises a first arm and a second arm, and wherein the first arm is substantially parallel to the second arm.

Example U. The apparatus of Examples S or T, wherein the at least one actuator comprises a hydraulic cylinder.

Example V. The apparatus of Example U, wherein the apparatus comprises a first hydraulic cylinder attached to the first arm and a second hydraulic cylinder attached to the second arm.

Example W. The apparatus of Example V, further comprising a substantially flat reinforcing member extending between the first side arm and the second side arm.

Example X. The apparatus of Example W, further comprising an arrangement of hydraulic fittings for the first hydraulic cylinder and the second hydraulic cylinder, wherein the hydraulic fittings are mounted on the reinforcing member.

Example Y. The apparatus of Example X, wherein the reinforcing member comprises an aperture housing the hydraulic fittings.

Example Z. The apparatus of Example Y, wherein the aperture comprise a removable cover.

Example AA. The apparatus of any of Examples S to Z, further comprising an elastomeric bumper on the distal edge of the frame.

Example BB. The apparatus of any of Examples S to AA, wherein the tool comprises a bucket.

Example CC. The apparatus of any of Examples S to BB, wherein the tool comprises a rake.

Example DD. An excavator bucket, comprising:

a linear top member comprising first and second substantially parallel hinge plates extending along a direction normal to a longitudinal axis of the top member, and wherein the hinge plates each comprise a front edge configured for attachment to a hydraulically activated excavator stick and a back edge attached to a power linkage on the stick;

a first side plate attached to a first end of the top member and a second side plate attached to a second end of the top member;

a heel section attached to the top member, the first side plate and the second side plate, wherein the heel section extends to a ground-contacting base edge between the first side plate and the second side plate;

a hydraulic thumb assembly attached to the top member, the hydraulic thumb assembly comprising:

a mount extending from the front edge of the top member, the mount comprising a first flange and a second flange between the first hinge plate and the first side plate, and a third flange and a fourth flange between the second hinge plate and the second side plate.

a frame with a first arm attached to the first flange and a second arm attached to the fourth flange, wherein the first arm is substantially parallel to the second arm, a first hydraulic cylinder attached to the first flange and the second flange, and a second hydraulic cylinder attached to the third flange and the fourth flange, and a distal edge between the first arm and the second arm, wherein the distal edge is configured to engage with the ground-contacting base edge, and wherein the first and the second hydraulic cylinders are configured to move the frame with respect to the ground-contacting base edge.

Example EE. The bucket of Example DD, wherein the first flange is attached to the first side plate and the fourth flange is attached to the second side plate.

Example FF. The bucket of any of Examples DD to EE, wherein the first flange, the second flange, the third flange, and the fourth flange extend along a direction normal to the longitudinal axis of the top member.

Example FF. The bucket of any of Examples DD to FF, further comprising a substantially flat reinforcing member extending between the first arm and the second arm.

Example GG. The apparatus of claim Example FF, wherein an arrangement of hydraulic fittings for the first hydraulic cylinder and the second hydraulic cylinder are mounted on the reinforcing member.

Example HH. The apparatus of Example GG, wherein the reinforcing member comprises a housing containing the hydraulic fittings.

Example II. The apparatus of Example HH, wherein the housing comprises a removable cover.

Example JJ. The apparatus of any of Examples DD to II, further comprising an elastomeric bumper on the distal edge of the frame.

Examples KK. A method comprising attaching a thumb apparatus to a front edge of a top member configured to transfer torque to a ground engaging tool, the thumb apparatus comprising a mount, at least one arm attached to the mount, and at least one actuator attached to the arm and the mount.

Example LL. The method of Example KK, wherein the top member comprises an arrangement of hinge plates extending from the front edge of the top member to a back edge thereof, wherein the hinge plates are configured to attach the tool to a stick and a power linkage on the stick, and wherein the mount comprises an arrangement of flanges attached to the top member outboard of the hinge plates.

Example MM. A kit, comprising:

a thumb apparatus configured for attachment to a torque tube of a ground engaging tool, wherein the torque tube comprises a front edge and a back edge, the thumb apparatus comprising:

a mount comprising a plurality of flanges configured for attachment to the front edge of the torque tube, a frame comprising at least one arm configured for attachment to the flanges, and at least one actuator configured for attachment to the mount and the frame.

Example NN. The kit of Example MM, further comprising fittings configured for attachment of the at least one actuator and a corresponding fitting on a member to which the ground engaging tool is to be attached.

Example OO. The kit of any of Examples MM to NN, wherein the torque tube comprises an interface member attached thereto, wherein the interface member extends from a front edge of the torque tube to a rear edge of the torque tube.

Example PP. The kit of Example OO, wherein the plurality of flanges comprises two pairs of substantially parallel flanges configured for mounting on the torque tube, wherein the flanges are configured to be mounted outboard of the interface member.

Example QQ. The kit of any of Examples NN to PP, wherein the frame comprises two substantially parallel arms.

Example RR. The kit of Example QQ, wherein a cross-member between the parallel arms comprises a housing, and the fittings are within the housing.

Example SS. The kit of Example RR, wherein the housing comprises a removable cover.

Example TT. The kit of any of Examples NN to SS, wherein the actuator comprises at least one hydraulic cylinder.

What is claimed is:

1. An apparatus, comprising:

a ground engaging tool comprising:

a bottom section, a back section, and opposing side sections coupled together; and a torque tube coupled to the back section and the opposing side sections, the torque tube including a front edge and a back edge, the back edge connected to the back section and the front edge arranged toward a front side of the ground engaging tool; and a thumb assembly attached to the front edge of the torque tube, the thumb assembly comprising:

a plurality of actuators and a plurality of pin connections;

a mount extending from the front edge of the torque tube, at least one arm pivotally attached to the mount and configured to pivot about a pivot axis on the front side of the ground engaging tool; and at least one actuator of the plurality of actuators attached to the mount and the at least one arm via at least one pin connection of the plurality of pin connections, wherein the actuator is configured to move the at least one arm with respect to the ground engaging tool, wherein all of the plurality of actuators and all of the plurality of pin connections of the thumb assembly are arranged forward of the pivot axis.

2. The apparatus of claim 1, wherein the at least one arm comprises a first arm and a second arm, wherein the first arm and the second arm extend along a direction normal to a longitudinal axis of the torque tube parallel to the pivot axis, and wherein the first arm is substantially parallel to the second arm.

3. The apparatus of claim 2, wherein a first end of the first arm and a first end of the second arm are attached to the mount, and a second end of the first arm and a second end of the second arm are attached to a distal edge of a frame of the thumb assembly.

4. The apparatus of claim 3, wherein a first actuator is attached to a first flange of the mount and extends substantially parallel to the first arm, and a second actuator is attached to a second flange of the mount and extends substantially parallel to the second arm.

5. The apparatus of claim 4, wherein the first actuator and the second actuator are independently chosen from electrical, mechanical, hydraulic, pneumatic, piezoelectric, and combinations thereof.

6. A thumb apparatus, comprising:

a plurality of actuators and a plurality of pin connections;

a mount comprising an arrangement of flanges configured for attachment to a front edge of a torque tube of a ground engaging tool, wherein the ground engaging tool comprises a bottom section, a back section, and opposing side sections coupled together and the torque tube is coupled to the back section and the opposing side sections with the front edge arranged toward a front side of the ground engaging tool;

a frame pivotally attached to the flanges, wherein the frame comprises a distal edge configured to engage with a ground-contacting portion of the tool and the frame is configured to pivot about a pivot axis on the front side of the ground engaging tool, and at least one actuator of the plurality of actuators attached to the flanges and the frame via pin connections of the plurality of pin connections, wherein the actuator is configured to move the frame with respect to the ground engaging tool, wherein all of the plurality of actuators and all of the plurality of pin connections of the thumb apparatus are configured to be arranged on the ground engaging tool forward of the pivot axis.

7. The apparatus of claim 6, wherein the frame comprises a first arm and a second arm, and wherein the first arm is substantially parallel to the second arm.

8. The apparatus of claim 6, wherein the at least one actuator comprises a hydraulic cylinder.

9. The apparatus of claim 6, wherein the tool comprises a bucket.

10. The apparatus of claim 6, wherein the tool comprises a rake.

11. A kit, comprising:

a thumb apparatus configured for attachment to a torque tube of a ground engaging tool, wherein the torque tube comprises a front edge and a back edge, the ground engaging tool comprises a bottom section, a back section, and opposing side sections coupled together and the torque tube is coupled to the back section and the opposing side sections with the front edge arranged toward a front side of the ground engaging tool, the thumb apparatus comprising:

a plurality of actuators and a plurality of pin connections;

a mount comprising a plurality of flanges configured for attachment to the front edge of the torque tube, a frame comprising at least one arm configured for pivotal attachment to the flanges and configured to pivot about a pivot axis on the front side of the ground engaging tool, and at least one actuator of the plurality of actuators configured for attachment to the mount and the frame via pin connections of the plurality of pin connections, wherein all of the plurality of actuators and all of the plurality of pin connections of the thumb apparatus are configured to be arranged on the ground engaging tool forward of the pivot axis.

12. The kit of claim 11, further comprising fittings configured for attachment of the at least one actuator and a corresponding fitting on a member to which the ground engaging tool is to be attached.

13. The kit of claim 11, wherein the torque tube comprises an interface member attached thereto, wherein the interface member extends from the front edge of the torque tube to the back edge of the torque tube.

14. The kit of claim 13, wherein the plurality of flanges comprises two pairs of substantially parallel flanges configured for mounting on the torque tube, wherein the flanges are configured to be mounted outboard of the interface member.

15. The kit of claim 11, wherein the frame comprises two substantially parallel arms.

16. The kit of claim 15, further comprising fittings configured for attachment of the at least one actuator, and wherein a crossmember between the parallel arms comprises a housing, and the fittings are within the housing.

17. The kit of claim 16, wherein the housing comprises a removable cover.

18. The kit of claim 11, wherein the at least one actuator comprises at least one hydraulic cylinder.

19. The kit of claim 15, wherein the at least one actuator comprises two hydraulic cylinders, and wherein each of the hydraulic cylinders is attached to one arm of the two substantially parallel arms.

* * * * *